United States Patent [19]

Parrott et al.

[11] 4,125,227

[45] Nov. 14, 1978

[54] BREAKING APPARATUS FOR USE WITH A CONVEYOR

[75] Inventors: George A. Parrott, Wakefield; John B. Norris, Leeds, both of England

[73] Assignee: Dresser Europe S.A., Brussels, Belgium

[21] Appl. No.: 817,212

[22] Filed: Jul. 20, 1977

[30] Foreign Application Priority Data

Jul. 22, 1976 [GB] United Kingdom ..... 30682/76

[51] Int. Cl.[2] ..... B02C 13/286

[52] U.S. Cl. ..... 241/186 R; 241/189 R

[58] Field of Search ..... 241/186 R, 189 R, 189 A, 241/277, 280, 281

[56] References Cited

U.S. PATENT DOCUMENTS 4,047,673 9/1977 Aylmann et al. ..... 241/186 R

FOREIGN PATENT DOCUMENTS 2,218,297 10/1973 Fed. Rep. of Germany ..... 241/189 R 2,309,280 11/1976 France ..... 241/186 R

*Primary Examiner*—Howard N. Goldberg

*Attorney, Agent, or Firm*—Larson, Taylor and Hinds

[57] ABSTRACT

Breaking apparatus for use with a conveyor and intended to be used in a coal mine comprises a frame generally of inverted U-shape bridging the conveyor and secured to its opposite side walls. A rotary breaking element is drivably carried on an arm assembly mounted on the frame, and a reaction plate on the frame is spaced from an adjacent periphery of the rotary element. In use, coal and rocks on the conveyor pass between the rotary element and reaction plate where they are broken up by the rotary element as it rotates.

12 Claims, 7 Drawing Figures

BREAKING APPARATUS FOR USE WITH A CONVEYOR

This invention relates to breaking apparatus for use with a conveyor.

According to the invention, there is provided breaking apparatus for conveyed material, comprising a frame constructed to lie along a path of or for conveyed material, a rotary breaking element drivably carried by the said frame for rotation about a generally vertically extending axis, and non-driven reaction means on the frame against which material may be impacted, the reaction means being spaced laterally, with respect to the direction in which the path extends, from an adjacent periphery of the rotary element so as to lie laterally adjacent the path and extend generally upwardly to define between the rotary element and the reaction means a material breaking gap, whereby, in use of the apparatus, material on the path entering the material breaking gap is broken by a generally sideways breaking action against the reaction means by the rotary element as the latter rotates.

Preferably the reaction means is in the form of a reaction plate.

Preferably, the frame is generally of inverted U-shape with the frame resting on the limbs of the U and bridging the conveyor when in use. The frame may be secured to the opposite side walls of the conveyor. Preferably, the rotary element is mounted with its axis of rotation upright. In a preferred arrangement the rotary element is movably mounted on the frame and means are provided for adjusting the spacing of the rotary element from the reaction plate. The adjusting means, comprising a hydraulic piston/cylinder arrangement for example, may include an overload device which is operative to adjust the spacing between the rotary element and the reaction plate to prevent the rotary element from being subjected to a predetermined overload. The hydraulic cylinder can incorporate a relief valve as said overload device.

Expediently, the rotary element is mounted on an arm assembly pivotally attached at one end to the frame. Preferably, the arm assembly is capable of being raised and lowered relatively to the frame. Alternatively, the rotary element is vertically displaceable with respect to the arm assembly.

The breaking apparatus may further comprise an electric motor and a fluid coupling connecting the electric motor to the rotary element via a gearbox.

The reaction plate can be constructed so as to be detachable from the frame. The rotary breaking element preferably comprises a drum carrying picks.

It is desirable for the frame and arm assembly of the apparatus to be of symmetrical construction about a given longitudinal vertical plane through the apparatus.

For a better understanding of the invention and to show how the same may be carried into effect, reference will now be made, by way of example, to the accompanying drawings, in which.

Figure 1:
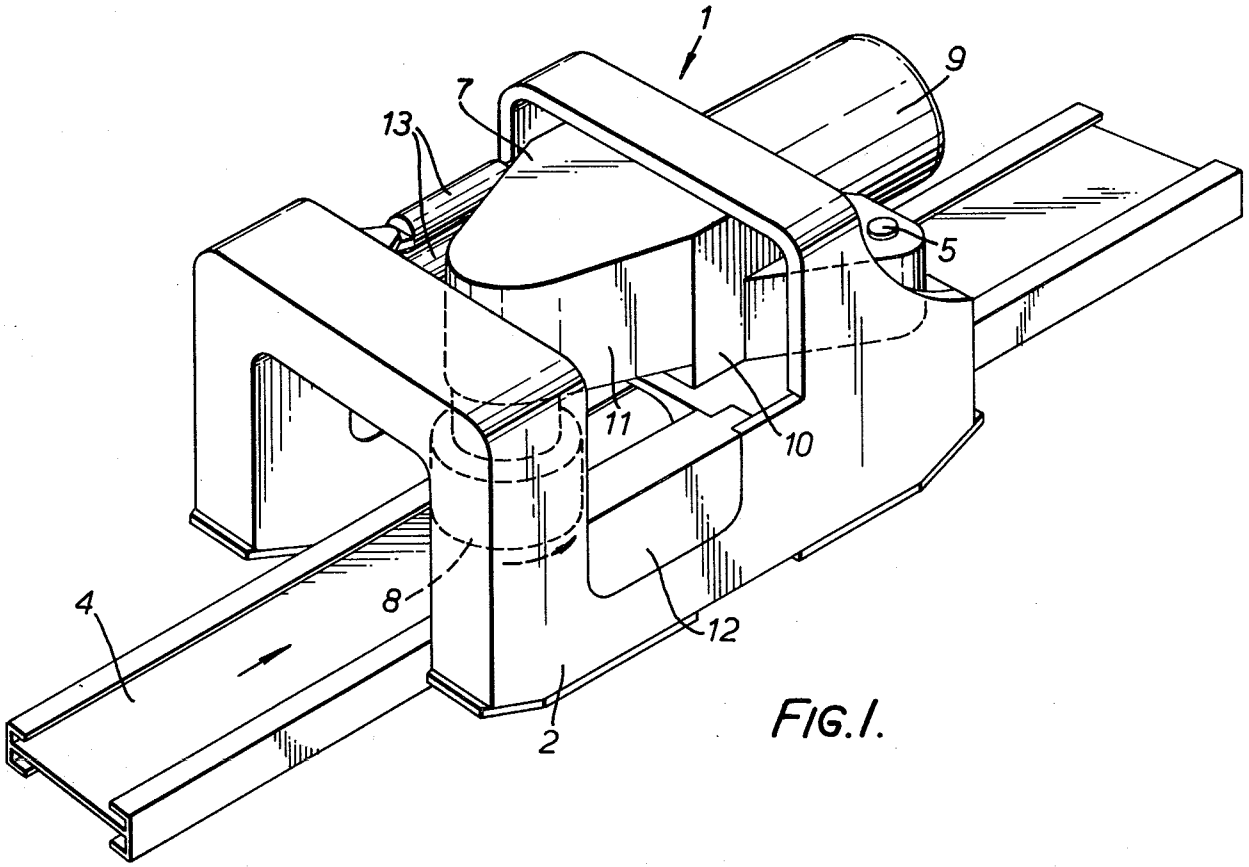
FIG. 1 is a general perspective view of one form of breaking or crushing apparatus in accordance with the invention.
Figure 2:
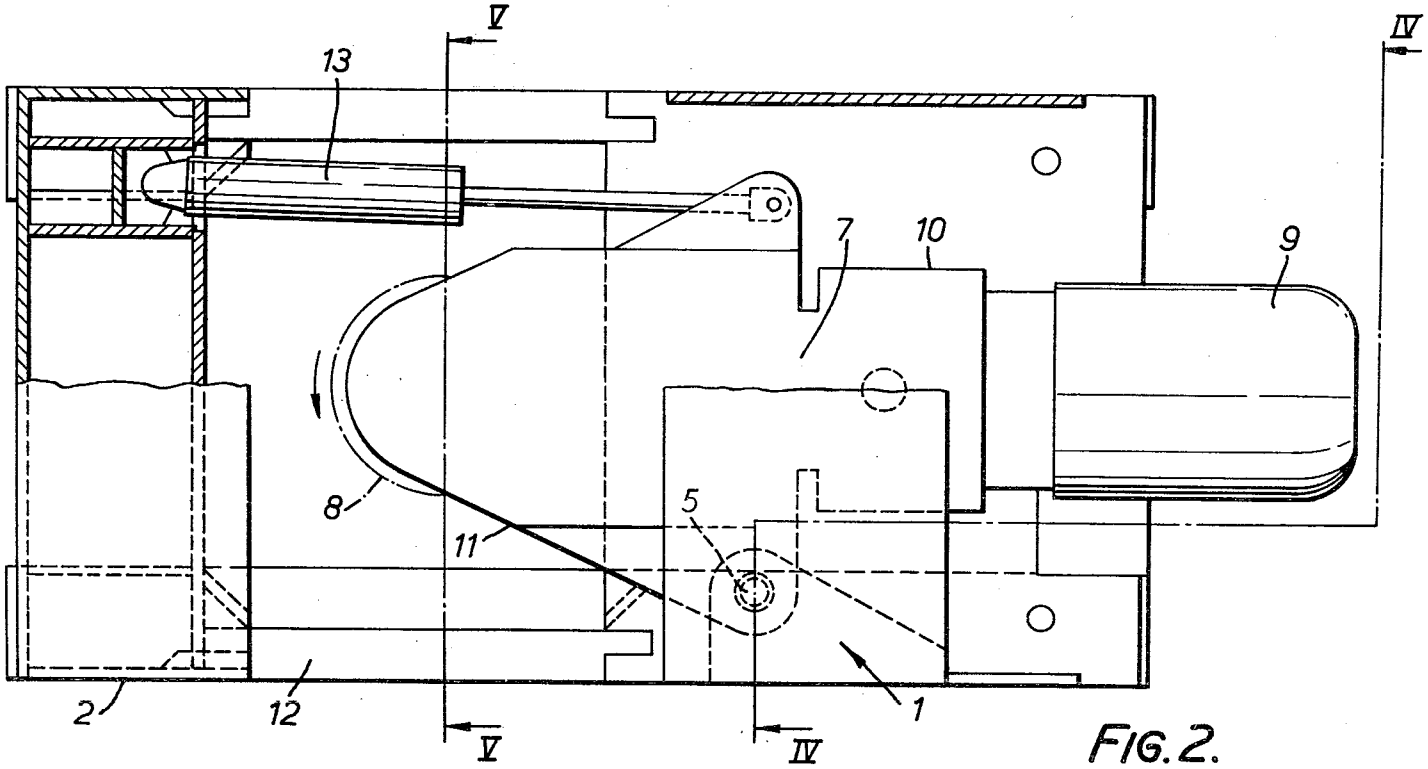
FIG. 2 is a plan view of the apparatus.
Figure 3:
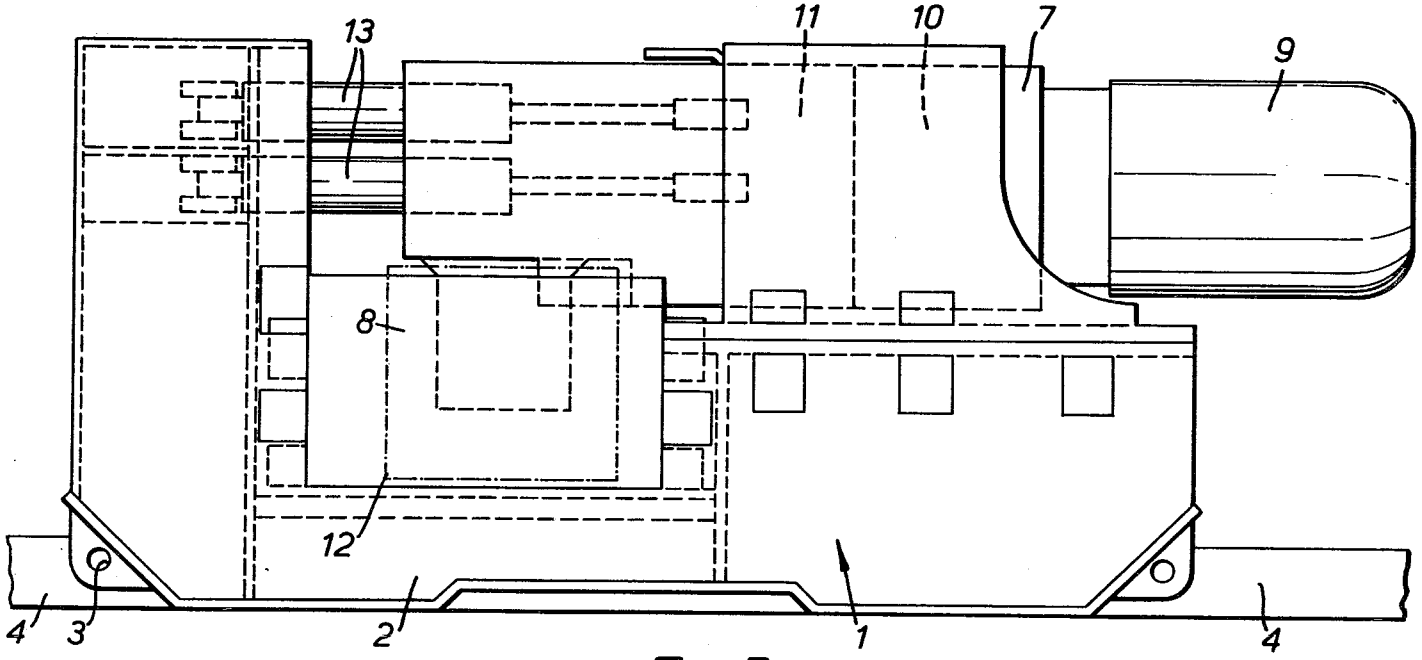
FIG. 3 is a side view of the apparatus.
Figure 4:
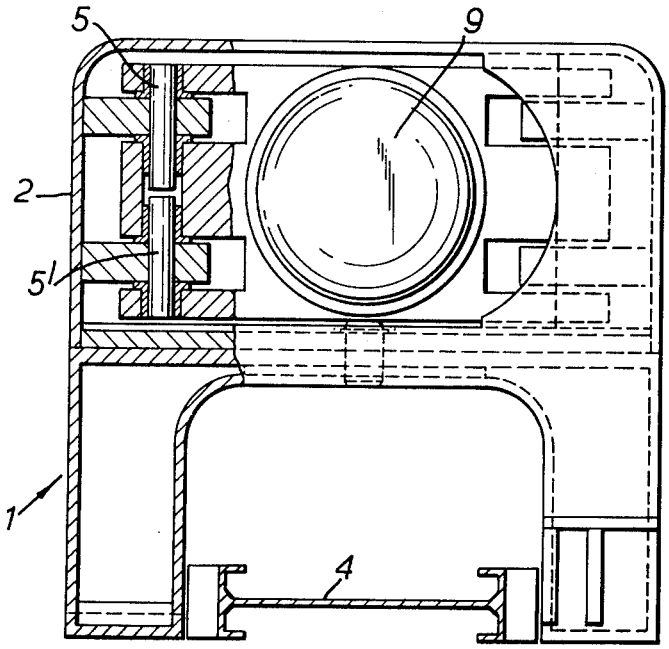
FIG. 4 is a sectional view of the apparatus, taken along the line IV—IV of FIG. 2.
Figure 5:
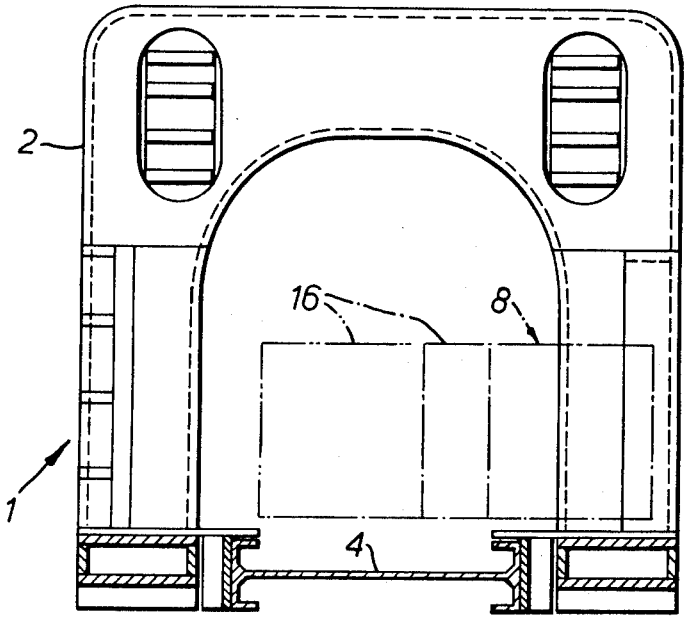
FIG. 5 is a sectional view of the apparatus, taken along the line V—V of FIG. 2.

Referring to FIGS. 1 to 5, the breaking apparatus, shown at 1, comprises a frame 2, which is generally of inverted U-shaped construction and rests on the limbs of the U so as to bridge a scraper-type loader conveyor 4 which is used to convey coal from an armoured face conveyor away from the coal face. The frame 2 is secured to the opposite side walls of the conveyor by bolts passing through holes 3 in the frame 2.

The apparatus 1 further comprises an arm assembly 7 which is pivotally attached by means of pins 5, 5' to the frame 2 so that a rotary, coal breaking drum 8, which is carried by one end of the arm assembly at its underside and which is driven by an electric motor 9, mounted on the arm assembly, by way of a fluid coupling 10 and a 90° gear box 11, can be displace towards and away from a reaction plate 12 attached to a side portion of the frame 2. The reaction plate is constructed to be detachable from the frame 2, in order to allow easy access to the drum 8 and arm assembly 7 for maintenance purposes. The drum 8 carries picks (not shown) in order to break-up or crush coal and other material and is driven in the direction of rotation indicated, the peripheral speed of the drum being greater than the conveyor speed in order that material fed by the conveyor to the apparatus 1 can be impacted against the reaction plate 12 by the rotating drum.

The drum 8 can be arranged to be vertically displaceable with respect to the conveyor. This can be achieved by making the whole arm assembly 7 capable of being raised and lowered relatively to the frame 2 or, alternatively, by arranging for the drum to be vertically displaceable with respect to the arm assembly. The spacing between the bottom of the drum and the top of the armoured face conveyor determines the size of coal and other material which is allowed to pass beneath the drum without being impacted against the reaction plate.

Figure 6:
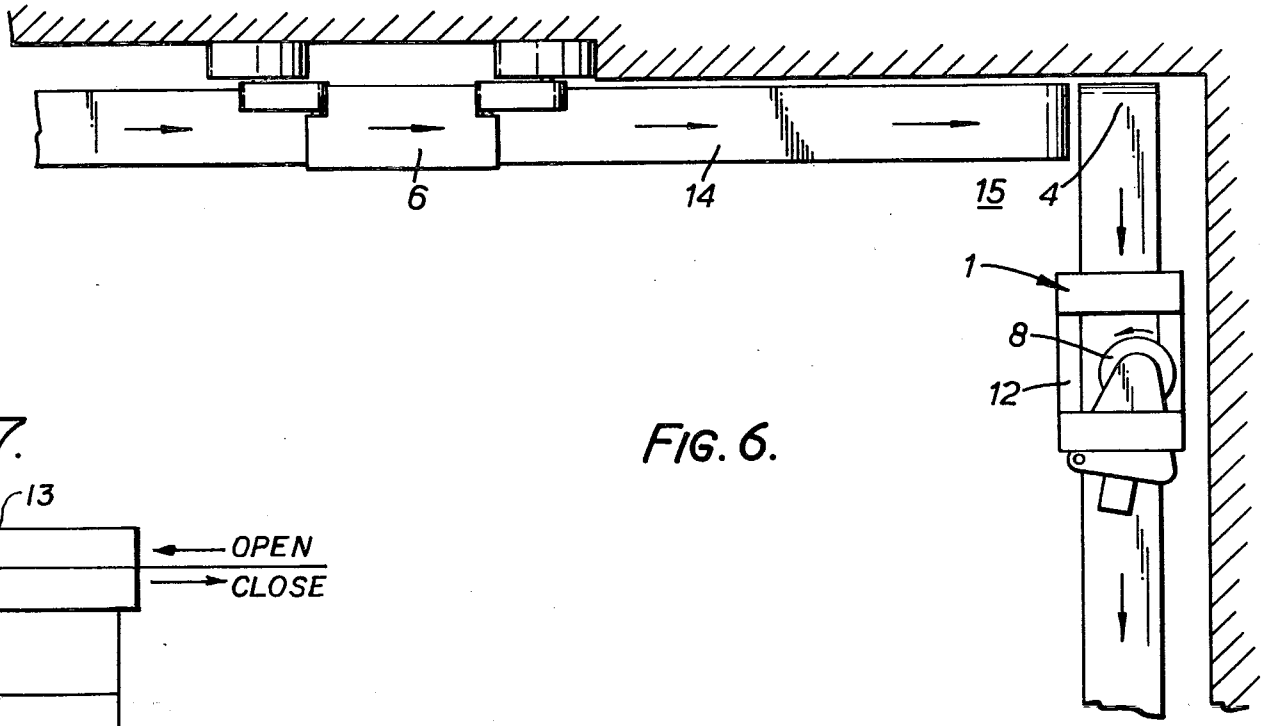
FIG. 6 illustrates diagrammatically the manner in which the apparatus can be used to break or crush lumps of coal being conveyed away from the coal face by a scraper-type loader conveyor.

FIG. 6 illustrates the use of a longwall mining machine 6 on an armoured face conveyor 14, the so-called "main gate" drive (where coal arriving at the end of the conveyor is transferred to the scraper-type loader conveyor 4 carrying the coal away from the coal face) being represented by reference numeral 15. During mining, lumps of coal, rock and other material, mostly removed from the coal face by the machine 6 but some having fallen away from the coal face, are fed by the armoured face conveyor 14 onto the conveyor 4, which conveys the lumps through the opening of the loading entrance between the rotary drum 8 and the reaction plate 12 of the breaking apparatus 1. Especially in the case where thick seam sections are being mined, some of the lumps of coal, stone and other material fed onto the conveyor 4 may be larger than required, but these are impacted or crushed by the rotating drum 8 against the reaction plate 12 as they are carried along by the loader conveyor 4. The lumps leaving the breaking apparatus are then of the required size.

The width of the opening between the drum and reaction plate can be adjusted by pivoting the arm assembly 7 about its vertical pivot axis, twin adjusting, hydraulic rams 13 (FIG. 3) being provided for this purpose. The drum positions 16 in FIG. 5 indicate the limits between which the drum can be adjusted in position.

Figure 7:
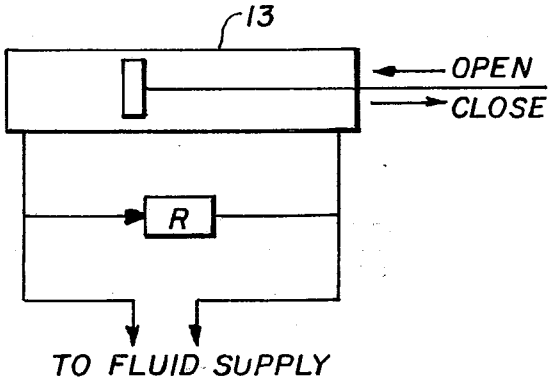
FIG. 7 illustrates, highly diagrammatically, an adjusting, hydraulic, piston/cylinder arrangement for adjusting the width of the opening between the drum and reaction plate, with the hydraulic supply and overload relief depicted in highly simplified form.

The hydraulic cylinder of each ram can also incorporate a relief valve, such as shown at R in FIG. 7, which relieves excess hydraulic pressure in the cylinder when a pre-set threshold value, corresponding to overloading of the breaking apparatus, is exceeded. Such pressure relief increases the size of the opening between the drum and reaction plate to prevent damage to the apparatus in the event of an overload, such as occurs when any unbreakable material (e.g. tramp metal) enters between the drum and reaction plate.

We claim:

1. Breaking apparatus for conveyed material, comprising a frame constructed to lie along a path of or for conveyed material, a rotary breaking element drivably carried by the said frame for rotation about a generally vertically extending axis, and non-driven reaction means on the said frame against which material may be impacted, the reaction means being spaced laterally, with respect to the direction in which the path extends, from an adjacent periphery of the rotary element so as to lie laterally adjacent the path and extend generally upwardly to define between the rotary element and the reaction means a material breaking gap, whereby, in use of the apparatus, material on the path entering the material breaking gap is broken by a generally sideways breaking action against the reaction means by the rotary element as the latter rotates.

2. Apparatus according to claim 1, wherein the reaction means is in the form of a reaction plate.

3. Apparatus according to claim 2, wherein the frame is generally of inverted U-shape with the frame resting on the limbs of the U and bridging the said path.

4. Apparatus according to claim 3, wherein the frame is secured to the opposite side walls of a conveyor.

5. Apparatus according to claim 1, wherein the frame is generally of inverted U-shape with the frame resting on the limbs of the U and bridging the said path.

6. Apparatus according to claim 5, wherein the frame is secured to the opposite side walls of a conveyor.

7. Apparatus according to claim 1, wherein the rotary element is movably mounted on the frame and means are provided for adjusting the spacing of the rotary element from the reaction plate.

8. Apparatus according to claim 7, wherein the adjusting means includes an overload device which is operative to adjust the spacing between the rotary element and the reaction plate to prevent the rotary element from being subjected to overload.

9. Apparatus according to claim 7, wherein the adjusting means comprises a hydraulic piston/cylinder arrangement.

10. Apparatus according to claim 9, wherein the hydraulic cylinder is provided with a relief valve which is arranged to open to release hydraulic pressure in the hydraulic piston/cylinder/arrangement when the rotary element is subjected to a predetermined overload.

11. Apparatus according to claim 7, wherein the rotary element is mounted on an arm assembly pivotally attached at one end to the frame.

12. Apparatus according to claim 1, further comprising an electric motor and a fluid coupling connecting the electric motor to the rotary element via a gearbox.

* * * * *